US011086347B1

(12) United States Patent
Shou

(10) Patent No.: US 11,086,347 B1
(45) Date of Patent: Aug. 10, 2021

(54) BANDGAP REFERENCE CIRCUIT AND ELECTRONIC DEVICE

(71) Applicant: ZJW Microelectronics Limited, Shanghai (CN)

(72) Inventor: Xiaoqiang Shou, Shanghai (CN)

( * ) Notice: Subject to any disclaimer, the term of this patent is extended or adjusted under 35 U.S.C. 154(b) by 0 days.

(21) Appl. No.: 17/035,720

(22) Filed: Sep. 29, 2020

(51) Int. Cl.

| | |
|---|---|
| ***G05F 3/02*** | (2006.01) |
| ***G05F 3/20*** | (2006.01) |
| ***G05F 3/08*** | (2006.01) |
| ***G05F 3/22*** | (2006.01) |

(52) U.S. Cl.
CPC ..... *G05F 3/20* (2013.01); *G05F 3/02* (2013.01); *G05F 3/08* (2013.01); *G05F 3/225* (2013.01)

(58) Field of Classification Search
CPC ..... G05F 3/02; G05F 3/08; G05F 3/10; G05F 3/16; G05F 3/20; G05F 3/22; G05F 3/222; G05F 3/225; G05F 3/24; G05F 3/242; G05F 3/245
See application file for complete search history.

(56) References Cited

U.S. PATENT DOCUMENTS

2005/0218967 A1* 10/2005 Rashid ..... G05F 3/225 327/540
2018/0129239 A1* 5/2018 Lahiri ..... G05F 3/262

* cited by examiner

*Primary Examiner* — Long Nguyen

(57) ABSTRACT

The present disclosure provides a bandgap reference circuit which includes a basic reference module to generate a basic reference voltage containing a first linear temperature-coefficient (TC) voltage and a first nonlinear TC voltage when a terminal node in the basic reference module is grounded. The bandgap reference circuit further includes a compensation module with an output node coupled to the terminal node of the basic reference module. The compensation module generates a compensation voltage at the output node with a second linear TC term and a second nonlinear TC term by using a first set of current sources proportional to absolute temperate (PTAT) and a second set of current sources with TC of zero. And the bandgap reference circuit combines the basic reference voltage and the compensation voltage, cancelling all the linear and nonlinear terms, and thus create a composite reference voltage independent of temperature.

20 Claims, 6 Drawing Sheets

BANDGAP REFERENCE CIRCUIT AND ELECTRONIC DEVICE

CROSS REFERENCES TO RELATED APPLICATION

This application claims the benefits of priority to Chinese Patent Application No. CN 2020100842522, entitled "Bandgap Reference Circuit and Electronic Device", filed with CNIPA on Feb. 10, 2020, and Chinese Patent Application No. CN 2020201580039, entitled "Bandgap Reference Circuit and Electronic Device", filed with CNIPA on Feb. 10, 2020, the contents of which are incorporated herein by reference in their entireties.

TECHNICAL FIELD

The present disclosure relates to the technical field of circuit design, in particular, to a bandgap reference circuit and an electronic device.

BACKGROUND

Bandgap reference is a voltage source used as a voltage reference in analog circuits or mixed signal circuits. Bandgap voltage reference is one of the key building blocks in analog circuits and mixed signal circuits. Bandgap voltage reference has simple structure, yields high accuracy and low temperature coefficient, and thus has been widely used in integrated circuits.

The expression of the existing bandgap voltage reference includes the first-order linear component T of temperature and high-order non-linear component T ln(T). The first-order linear component T can be compensated by setting appropriate parameters while the high-order non-linear component T ln(T) normally is uncorrected. As a result, the reference voltage shows curvature as the temperature changes.

It is critical for those skilled in the art to improve the stability of the bandgap voltage reference and thus obtain higher accuracy.

SUMMARY

The present disclosure provides a bandgap reference circuit and an electronic device for solving the curvature in the bandgap reference voltage.

The present disclosure provides a bandgap reference circuit which includes a basic reference module to generate a basic reference voltage containing a first linear temperature-coefficient (TC) term and a first nonlinear TC term if a terminal node in the basic reference module is grounded. The bandgap reference circuit further includes a compensation module with an output node connected to the terminal node of the basic reference module. The compensation module generates a compensation voltage at the output node containing a second linear TC term and a second nonlinear TC term by using a first set of current sources proportional to absolute temperate (PTAT) and a second set of current sources with TC of zero. And the sum of the compensation voltage and the basic reference voltage creates a composite reference voltage, the first linear TC term and the second TC term cancelled out while the first nonlinear TC term and the second nonlinear TC term cancelled out, ensuring the composite reference voltage to be constant and temperature independent.

DESCRIPTION OF REFERENCE NUMERALS

Figure 1:
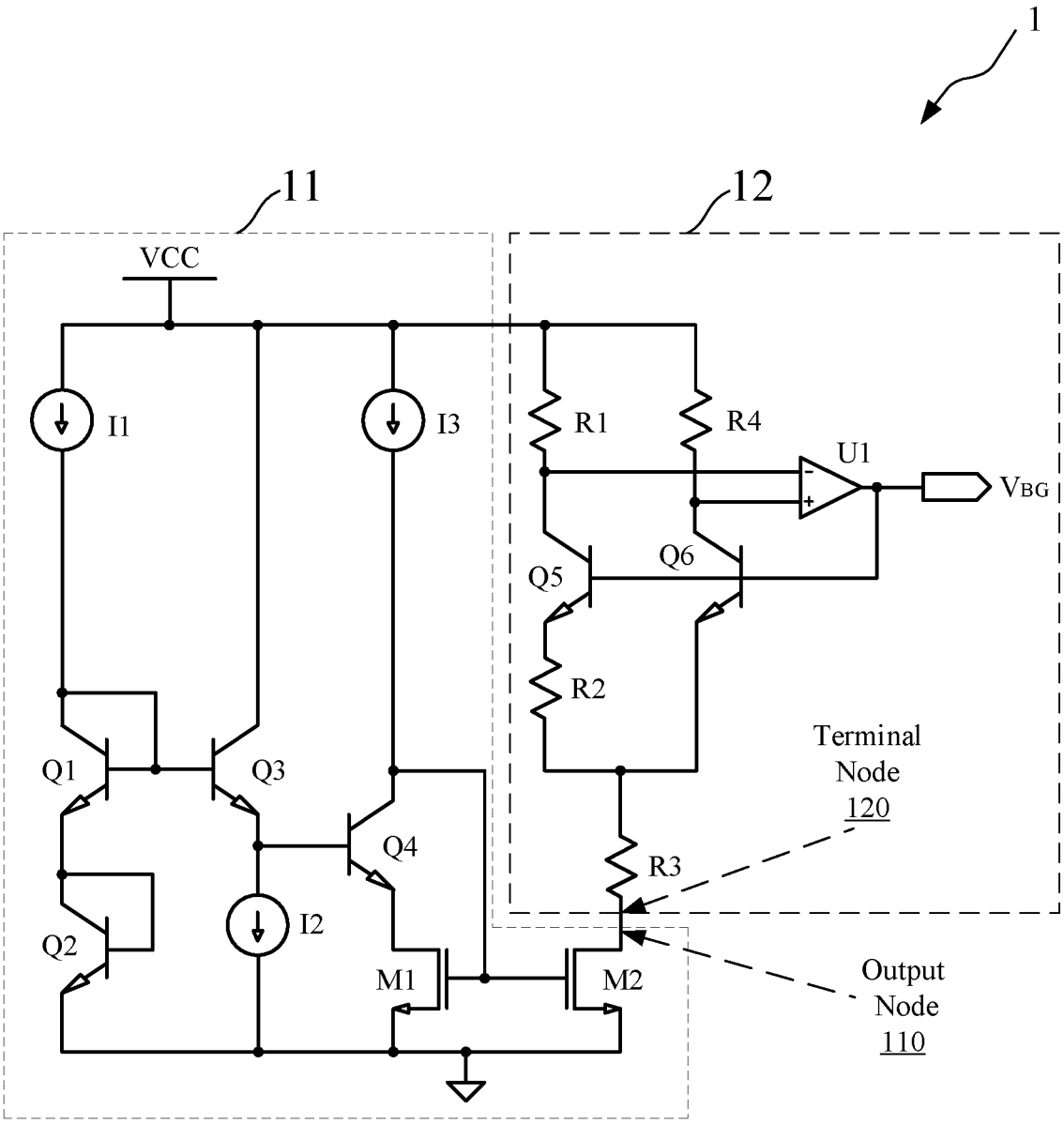
FIG. 1 is a schematic diagram showing a first structure of the bandgap reference circuit according to the present disclosure.
Figure 2:
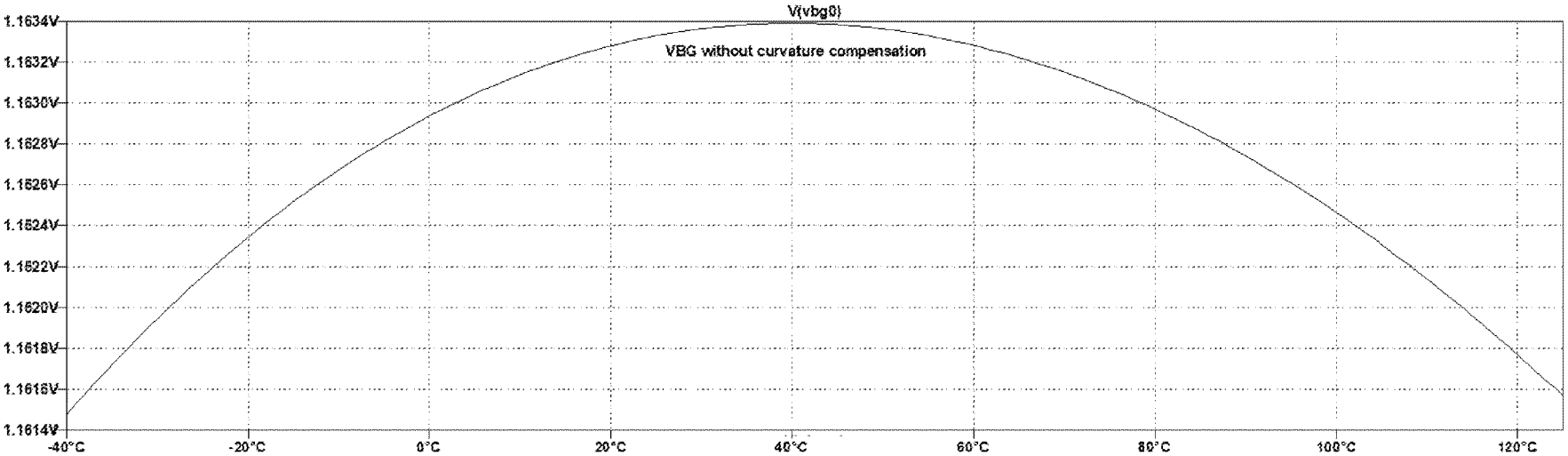
FIG. 2 is a schematic diagram showing the relationship between the basic reference voltage and the temperature without the curvature compensation.

1 Bandgap reference circuit
11 Compensation module
12 Basic reference module

DETAILED DESCRIPTION OF THE PREFERRED EMBODIMENTS

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated herein Referring to FIGS. 1-6. It needs to be stated that the drawings provided in the following embodiments are just used for schematically describing the basic concept of the present disclosure, thus only illustrating components related to the present disclosure and are not drawn according to the numbers, shapes and sizes of components during actual implementation, the configuration, number and scale of each component during actual implementation thereof may be freely changed, and the component layout configuration thereof may be more complicated.

Embodiment 1

FIG. 1 shows a bandgap reference circuit that can be used in an integrated circuit and/or electronic device, in accordance with at least some embodiments of the present disclosure. In FIG. 1, a bandgap reference circuit 1 may include, among other components and modules not shown, a compensation module 11 and a basic reference module 12. The basic reference module 12 may generate a basic reference voltage which has a nonlinear TC term if a terminal node 120 is grounded. The compensation module 11 may generate a compensation voltage to correct the nonlinear term in the basic reference voltage generated by the basic reference module 12. The compensation module 11 may include one or more current sources being proportional to absolute temperature, one or more current sources with a temperature coefficient of zero, and one or more transistors.

In some embodiments, an output node 110 of the compensation module 11 and a terminal node 120 of the basic reference module 12 may be connected. A "node" may be a physical connection in a circuit for connecting to another node or component, thereby allowing electric currency to pass through from one node to another node or component. A "terminal node" may refer to a point in the basic reference module 12 that may be either grounded or connected to the output node 110 of the compensation module 11. When the terminal node 120 is grounded, the basic reference module 12 may generate a basic reference voltage containing a linear TC term and a nonlinear TC term. When the terminal node 120 is connected to the output node 110 of the compensation module 11, the compensation module 11 may provide the compensation voltage through the output node 110 to the terminal node 120, which may in turn add the compensation voltage to the basic reference voltage and create a composite reference voltage. Such an approach may eliminate the linear TC terms and the nonlinear TC terms in the basic reference voltage. Therefore, the bandgap circuit may output a temperature independent composite reference voltage.

In some embodiments, the compensation module 11 includes a first current source 11, a second current source 12, a third current source 13, a first NPN transistor Q1, a second NPN transistor Q2, and a third NPN transistor Q3, a fourth NPN transistor Q4, a first NMOS transistor M1, and a second NMOS transistor M2.

In some embodiments, the value of the first current source 11 is proportional to absolute temperature (PTAT). The anode of the first current source 11 is connected to the power supply VCC, the cathode of the first current source 11 is connected to the collector of the first NPN transistor Q1. In this embodiment, the value of the first current source 11 is set to be $a_1$*T.

In some embodiments, the base of the first NPN transistor Q1 is connected to its collector, and the emitter of the first NPN transistor Q1 is connected to the collector of the second NPN transistor Q2. The base of the second NPN transistor Q2 is connected to its collector, and the emitter of the second NPN transistor Q2 is grounded. The collector of the third NPN transistor Q3 is connected to the power supply VCC. The base of the third NPN transistor Q3 is connected to the base of the first NPN transistor Q1 and the emitter of the third NPN transistor Q3 is connected to the anode of the second current source 12.

In some embodiments, the cathode of the second current source 12 is connected to ground. The current flowing through the second current source 12 is of a fixed value. In this embodiment, the value of the second current source 12 is set to be $I_{const1}$ independent of temperature. The anode of the third current source 13 is connected to the power supply VCC, and the cathode of the third current source 13 is connected to the collector of the fourth NPN transistor Q4. The value of the third current source 13 is PTAT. In this embodiment, the value of the third current source 13 is set to be $a_2$*T.

In some embodiments, the base of the fourth NPN transistor Q4 is connected to the emitter of the third NPN transistor Q3, and the emitter of the fourth NPN transistor Q4 is connected to the drain of the first NMOS transistor M1. The gate of the first NMOS transistor M1 is connected to the collector of the fourth NPN transistor Q4, and the source of the first NMOS transistor M1 is grounded. The source of the second NMOS transistor M2 is grounded, the gate of the second NMOS transistor M2 is connected to the gate of the first NMOS transistor M1, and the drain of the second NMOS transistor M2 is the output of the compensation module 11, providing the compensation voltage.

In some embodiments, the first NMOS transistor M1 and the second NMOS transistor M2 operate in triode, and the first NMOS transistor M1 matches the second NMOS transistor M2. The ratio between the channel width over length ratio of the first NMOS transistor M1 and that of the second NMOS transistor M2 is 1:$m_1$. The drain of second NMOS transistor M2 is labelled as 'output node' 110 of the compensation module 11.

As shown in FIG. 1, the bandgap circuit may generate a temperature-independent composite reference voltage $V_{BG}$ by cancelling the first order TC term in the basic reference voltage with the first order TC term in the compensation voltage, and cancelling the high order nonlinear curvature in a similar way.

Specifically, the basic reference module 12 includes the first resistor R1, the second resistor R2, the third resistor R3, the fourth resistor R4, the fifth NPN transistor Q5, the sixth NPN transistor Q6, and the first amplifier U1. The first terminal of the first resistor R1 is connected to the power supply VCC, and the second terminal of the first resistor R1 is connected to the collector of the fifth NPN transistor Q5. The emitter of the fifth NPN transistor Q5 is connected to the first terminal of the second resistor R2. The second terminal of the second resistor R2 is connected to the first terminal of the third resistor R3. The first terminal of the fourth resistor R4 is connected to the power supply VCC, and the second terminal of the fourth resistor R4 is connected to the collector of the sixth NPN transistor Q6. The emitter of the sixth NPN transistor Q6 is connected to the first terminal of the third resistor R3. The second terminal of R3 is labelled as 'terminal node' 120 of the basic reference module 12. In some embodiments, the terminal node 120 of the basic reference module 12 is connected to the output node 110 of the compensation module 11.

In some embodiments, the first resistor R1 and the fourth resistor R4 are of the same value. The ratio between the emitter area of the fifth NPN transistor Q5 and that of the sixth NPN transistor Q6 is $n_1$:1, where the specific value of $n_1$ may be set as required. The inverting input of the first amplifier U1 is connected to the collector of the fifth NPN transistor Q5, the non-inverting input of the first amplifier U1 is connected to the collector of the sixth NPN transistor Q6. The output of the first amplifier U1 is connected to the base of the fifth NPN transistor Q5 and to the base of the sixth NPN transistor Q6, providing the reference voltage $V_{BG}$.

As shown in FIG. 1, for a bipolar device, we have:

$$I_C = I_S \cdot e^{\frac{V_{BE}}{V_T}}, \tag{1}$$

where, $$V_T = \frac{kT}{q},$$

$I_C$ is the collector current, $I_S$ is the saturation current, $V_{BE}$ is the base-emitter voltage, $V_T$ is the thermal voltage, k is the Boltzmann constant, T is the absolute temperature in Kelvin, and q is the quantity of electron charge. Ignoring the base currents of the fifth NPN transistor Q5 and the sixth NPN transistor Q6, in the basic reference module 12, we can obtain:

$$I_{C5} = I_{C6} = \frac{V_{BE6} - V_{BE5}}{R_2} = V_T \frac{\ln(n_1)}{R_2}, \tag{2}$$

where $I_{C5}$ is the collector current of the fifth NPN transistor Q5, $I_{C6}$ is the collector current of the sixth NPN transistor Q6, $V_{BE5}$ is the base-emitter voltage of the fifth NPN transistor Q5, $V_{BE6}$ is the base-emitter voltage of the sixth NPN transistor Q6, $R_2$ is the resistance value of the second resistor R2, $n_1$ is the ratio between the emitter area of the fifth NPN transistor Q5 and that of the sixth NPN transistor Q6. It's easy to see $I_{C5}$ and $I_{C6}$ are PTAT.

In some embodiments, when the second terminal of the third resistor R3 is grounded, we can further obtain:

$$V_{BG} = V_{BE6} + 2 \cdot \frac{R_3}{R_2} \cdot \frac{kT}{q} \ln(n_1), \tag{3}$$

where, $V_{BG}$ is the basic reference voltage, $R_3$ is the resistance value of the third resistor R3. As the sixth NPN transistor Q6 operates with its collector current proportional to absolute temperature, the base-emitter voltage can be modelled as below:

$$V_{BE6} = V_{G0} - [V_{G0} - V_{BE0}]\frac{T}{T_0} - \frac{kT}{q}(\eta - \theta)\ln\left(\frac{T}{T_0}\right), \tag{4}$$

where, $V_{G0}$ is the bandgap voltage of silicon at zero Kelvin, $T_0$ is the reference temperature, $V_{BE0}$ is the base-emitter voltage of the transistor at the reference temperature $T_0$, η is a process-related constant (between 3.6~4), θ is determined by the temperature dependence of collector current (θ=1 when the collector current is PTAT).

Combining equation (3) and equation (4), we can further obtain:

$$V_{BG} = V_{G0} - [V_{G0} - V_{BE0}]\frac{T}{T_0} - \frac{kT}{q}(\eta - \theta)\ln\left(\frac{T}{T_0}\right) + 2 \cdot \frac{R_3}{R_2} \cdot \frac{kT}{q}\ln(n_1), \tag{5}$$

In the above equation, by selecting appropriate $$\frac{R_3}{R_2},$$

the linear component T in the second and third terms can be cancelled by the fourth term, so as to obtain a basic reference voltage $V_{BG}$, which is relatively constant over temperature. Thus, the curvature of the basic reference voltage $V_{BG}$ caused by T ln(T) becomes the main source of error affecting the basic reference voltage $V_{BG}$ stability over temperature, and severely restricts the overall accuracy of the bandgap reference circuit.

To generalize the above analysis on the circuit in FIG. 1, when the terminal node 120 of the basic reference module 12 is grounded, the basic reference voltage contains significant amount of high-order non-linear component T ln(T). In some embodiments, instead of being grounded, the terminal node 120 of the basic reference module 12 is connected to the output node 110 of the compensation module 11. The compensation module 11 raises the basic reference voltage $V_{BG}$ and a composite reference voltage is generated. The new composite reference voltage $V_{BGC}$ satisfies the following relationship:

$$V_{BGC} = V_{G0} - [V_{G0} - V_{BE0}]\frac{T}{T_0} - \frac{kT}{q}(\eta - \theta)\ln\left(\frac{T}{T_0}\right) + 2 \cdot \frac{R_3}{R_3} \cdot \frac{kT}{q}\ln(n_1) + V_{ds2}, \tag{6}$$

where, $V_{ds2}$ is the drain-source voltage of the second NMOS transistor M2. Furthermore, the drain-source voltage $V_{ds2}$ of the second NMOS transistor M2 satisfies the following relationship:

$$V_{ds2} = 2r_{ds2}\frac{kT}{q \cdot R_2} ln(n_1), \tag{7}$$

$$r_{ds2} = \frac{r_{ds1}}{m_1} = \frac{V_{ds1}}{a_2 \cdot T \cdot m_1}, \tag{8}$$

$$V_{ds1} = V_{BE1} + V_{BE2} - V_{BE3} - V_{BE4}, \tag{9}$$

$$V_{ds1} = \frac{kT}{q}\ln\left(\frac{a_1^2 \cdot T}{a_2 \cdot I_{const1}}\right), \tag{10}$$

where, $r_{ds2}$ is the drain-source resistance of the second NMOS transistor M2 biased in triode, $r_{ds1}$ is the drain-source resistance of the first NMOS transistor M1 biased in triode, $V_{ds1}$ is the drain-source voltage of the first NMOS transistor M1, $V_{BE1}$ is the base-emitter voltage of the first NPN transistor Q1, $V_{BE2}$ is the base-emitter voltage of the second NPN transistor Q2, $V_{BE3}$ is the base-emitter voltage of the third NPN transistor Q3, $V_{BE4}$ is the base-emitter voltage of the fourth NPN transistor Q4.

Combining equations (6)~(10), we have:

$$V_{BGC} = V_{G0} - [V_{G0} - V_{BE0}] \cdot \frac{T}{T_0} - \frac{kT}{q} \cdot (\eta - \theta) \cdot \ln\left(\frac{T}{T_0}\right) + 2 \cdot \frac{R_3}{R_2} \cdot \frac{kT}{q}\ln(n_1) + 2 \cdot \frac{kT}{q \cdot R_2} \cdot \ln(n_1) \cdot \frac{k}{q \cdot a_2 \cdot m_1} \cdot \ln\left(\frac{a_1^2 \cdot T}{a_2 \cdot I_{const1}}\right) \tag{11}$$

By setting appropriate $$\frac{R3}{R2},$$

Figure 3:
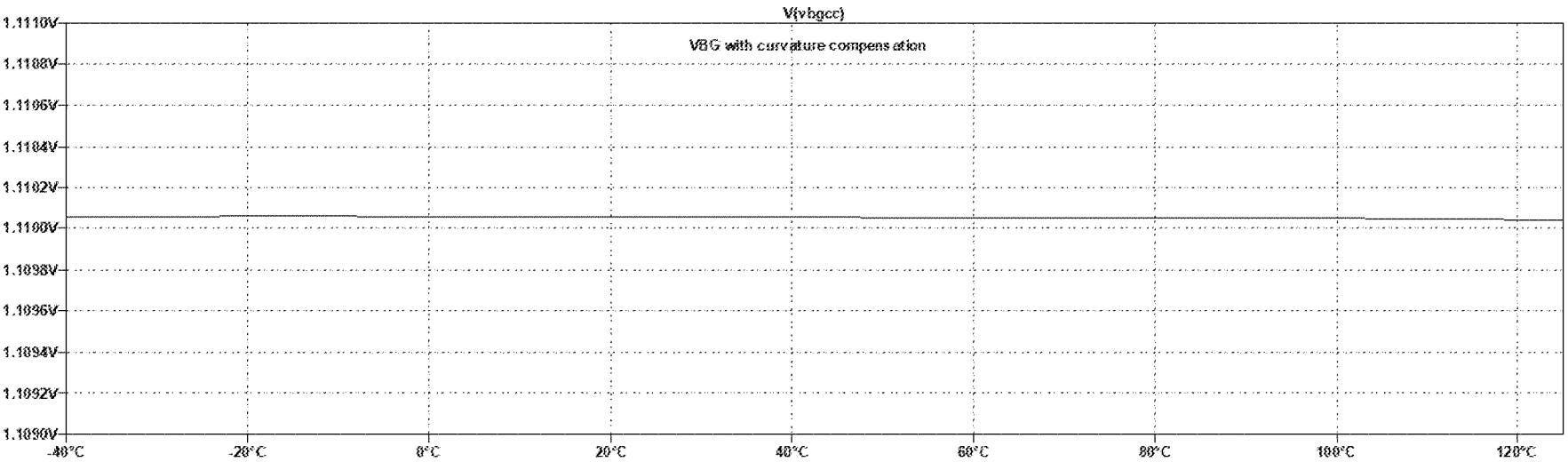
FIG. 3 is a schematic diagram showing the relationship between the composite reference voltage and the temperature with the curvature compensation according to the present disclosure.

$I_{const1}$, $a_1$, $a_2$ and $m_1$, the linear component T in the second term and the third term can be cancelled by that in the fourth term and the fifth term, and the high-order non-linear component T ln(T) in the third term can be cancelled by that in the fifth term, resulting in a composite reference voltage with improved temperature stability. As shown in FIG. 3, it is clear that the new curvature of the composite reference voltage $V_{BGC}$ is significantly reduced after the introduction of the compensation module 11.

In other words, when its terminal node is grounded, the basic reference module 12 may generate a reference voltage that contains a first linear TC term and a first nonlinear TC term. The compensation module 11 may generate a compensation voltage at its output node 110 when PTAT current flows into the output node, which contains a second linear TC term and a second nonlinear TC term. When the terminal node 120 of the basic reference module 12 and the output node 110 of the compensation module 11 are connected, the compensation voltage from the compensation module 11 is in series with the basic reference voltage of the basic reference module 12. In this case, the bandgap reference circuit may compensate the first linear TC term with the second linear TC term, and compensate the first nonlinear TC term with the second nonlinear TC term. For example, the first linear TC term may be positive, and the second linear TC voltage may be negative, and these two linear TC terms may cancel out each other when combined. The first nonlinear TC term and the second nonlinear TC term may be likewise combined to cancel each other. The resulting composite reference voltage, which appears at the output of the bandgap reference circuit, may become temperature independent.

Embodiment 2

Figure 4:
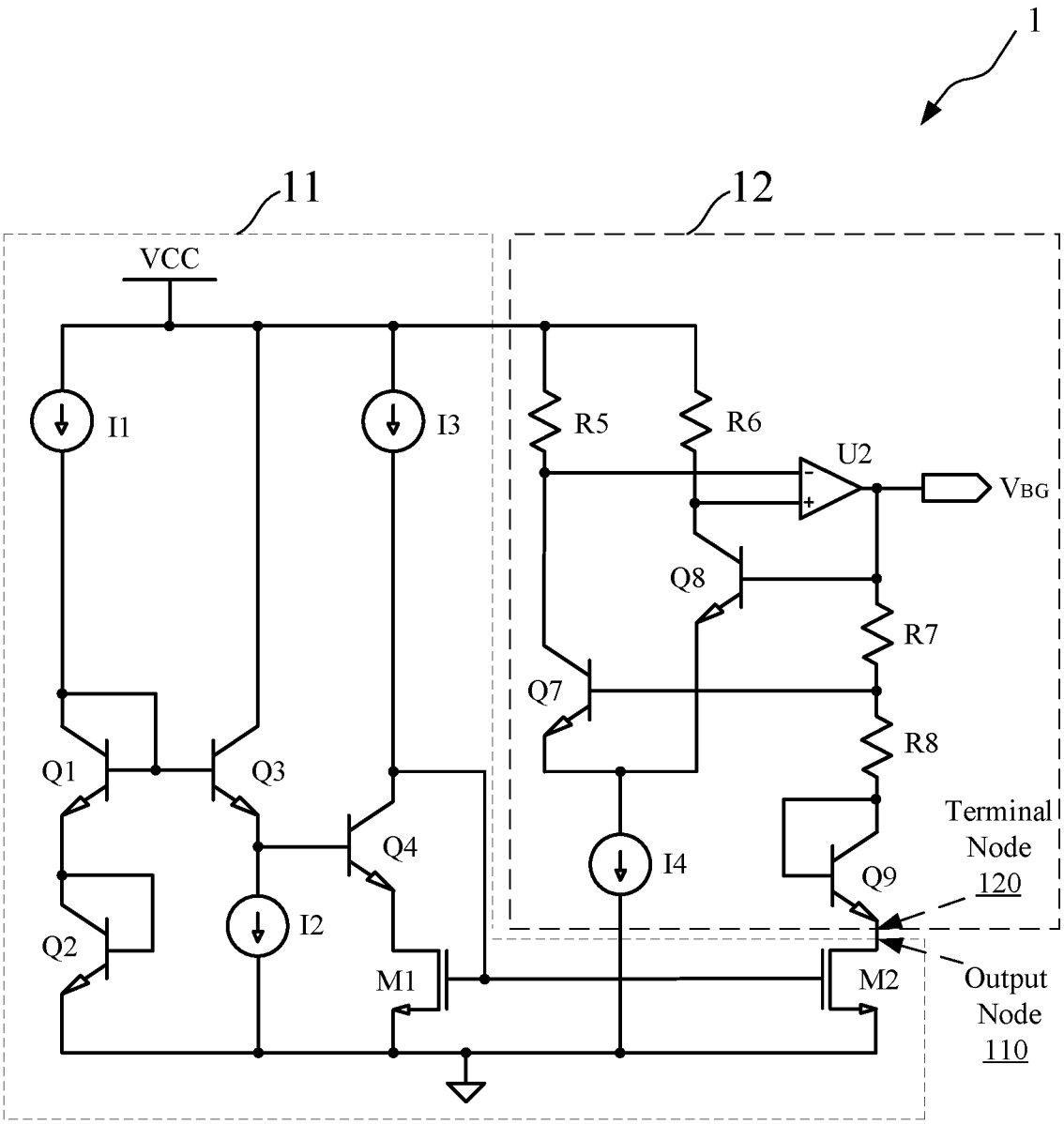
FIG. 4 is a schematic diagram showing a second structure of the bandgap reference circuit according to the present disclosure.

FIG. 4 shows a second bandgap reference circuit that can be used in an integrated circuit and/or electronic device, in accordance with at least some embodiments of the present disclosure. In FIG. 4, a bandgap reference circuit 1 may include, among other components and modules not shown, a compensation module 11 and a basic reference module 12. The basic reference module 12 may generate a basic reference voltage which contains a first order TC component and high order nonlinear TC component. The compensation module 11 may generate a compensation voltage to correct the high order nonlinear component in the basic reference voltage. The compensation module 11 may include one or more current sources being PTAT, one or more current sources with TC of zero, and one or more transistors.

As shown in FIG. 4, the compensation module 11 may be similar to the compensation module 11 of FIG. 1. The drain of the second NMOS transistor M2 is labelled as the output node 110. The basic reference module 12 of FIG. 4 is different from the basic reference module 12 of FIG. 1. Specifically, the former includes a fourth current source 14, a fifth resistor R5, a sixth resistor R6, a seventh resistor R7, an eighth resistor R8, a seventh NPN transistor Q7, and an eighth NPN transistor Q8, a ninth NPN transistor Q9 and second amplifier U2.

In some embodiments, the first terminal of the fifth resistor R5 is connected to the power supply VCC, and the second terminal of the fifth resistor R5 is connected to the collector of the seventh NPN transistor Q7. The emitter of the seventh NPN transistor Q7 is connected to the anode of the fourth current source 14 while the cathode of the fourth current source 14 is grounded.

In some embodiments, the first terminal of the sixth resistor R6 is connected to the power supply VCC, and the second terminal of the sixth resistor R6 is connected to the collector of the eighth NPN transistor Q8. The sixth resistor R6 and the fifth resistor R5 are of the same resistance value. The emitter of the eighth NPN transistor Q8 is connected to anode of the fourth current source 14 while the cathode of the fourth current source 14 is grounded. The ratio between the emitter area of the seventh NPN transistor Q7 and that of the eighth NPN transistor Q8 is $n_2$:1. The specific value of $n_2$ can be set as required. The current in the fourth current source 14 is constant over temperature.

The inverting input of the second amplifier U2 is connected to the collector of the seventh NPN transistor Q7, the non-inverting input of the second amplifier U2 is connected to the collector of the eighth NPN transistor Q8, and the output of the second amplifier U2 is connected to the base of the eighth NPN transistor Q8, providing the composite reference voltage $V_{BGC}$.

The first terminal of the seventh resistor R7 is connected to the output of the second amplifier U2, and the second terminal of the seventh resistor R7 is connected to the base of the seventh NPN transistor Q7. The first terminal of the eighth resistor R8 is connected to the base of the seventh NPN transistor Q7, and the second terminal of the eighth resistor R8 is connected to the collector of the ninth NPN transistor Q9. The base of the ninth NPN transistor Q9 is connected to its collector, and its emitter is connected to the output of the compensation module 11. The emitter of the ninth NPN transistor Q9 is labelled as the terminal node 120 of the basic reference module 12. The terminal node 120 of the basic reference module 12 is connected to the output node 110 of the compensation module 11.

Based on the basic reference module 12 shown in FIG. 4, it can be shown that:

$$I_{R7} = \frac{kT}{q} \cdot \frac{\ln(n_2)}{R_7}, \tag{12}$$

$$V_{BGC} = V_{BE9} + \frac{kT}{q} \cdot \frac{\ln(n_2)}{R_7} \cdot (R_7 + R_8) + \frac{kT}{q} \cdot \frac{\ln(n_2)}{R_7} \cdot r_{ds2}, \tag{13}$$

where $I_{R7}$ is the current flowing through the seventh resistor R7, $R_7$ is the resistance value of the seventh resistor R7, $R_8$ is the resistance value of the eighth resistor R8, $V_{BE9}$ is the base-emitter voltage of the ninth NPN transistor Q9, $n_2$ is the ratio between the emitter area of the seventh NPN transistor Q7 to that of the eighth NPN transistor Q8.

Therefore, combining equations (4), (8)~(10) and equation (13), we find the reference voltage $V_{BGC}$ satisfies the following relationship:

$$V_{BGC} = V_{G0} - [V_{G0} - V_{BE0}]\frac{T}{T_0} - \frac{kT}{q}(\eta - \theta)\ln\left(\frac{T}{T_0}\right) + \frac{kT}{q} \cdot \frac{\ln(n_2)}{R_7} \cdot (R_7 + R_8) + \frac{kT}{q} \cdot \frac{\ln(n_2)}{R_7} \cdot \frac{k}{q \cdot a_2 \cdot m_1} \cdot \ln\left(\frac{a_1^2 \cdot T}{a_2 \cdot I_{const1}}\right), \tag{14}$$

by setting appropriate $$\frac{R_7 + R_8}{R_7},$$

$I_{const1}$, $a_1$, $a_2$ and $m_1$, the first-order linear component T in the second term and the third term can be cancelled by that in the fourth term and the fifth term, and the high-order nonlinear component T ln(T) in the third term can be cancelled by that in the fifth term, thereby resulting in a composite reference voltage with improved temperature stability.

In other words, when its terminal node 120 is grounded, the basic reference module 12 may generate a basic reference voltage that contains a first linear TC term and a first nonlinear TC term. The compensation module 11 may generate a compensation voltage at its output node 110 which contains a second linear TC term and a second nonlinear TC term. When the terminal node 120 of the basic reference module 12 and the output node 110 of the compensation module 11 are connected, the compensation voltage is in series with the basic reference-voltage. In this case, the bandgap reference circuit may compensate the first linear TC term with the second linear TC term, and compensate the first nonlinear TC term with the second nonlinear TC term. For example, the first linear TC term may be positive, and the second linear TC term may be negative, and these two linear TC terms may cancel out each other when combined. The first nonlinear TC term and the second nonlinear TC term may be likewise combined to cancel each other. The resulting composite reference voltage, which appears at the output of the bandgap reference circuit, may become temperature independent.

Embodiment 3

Figure 5:
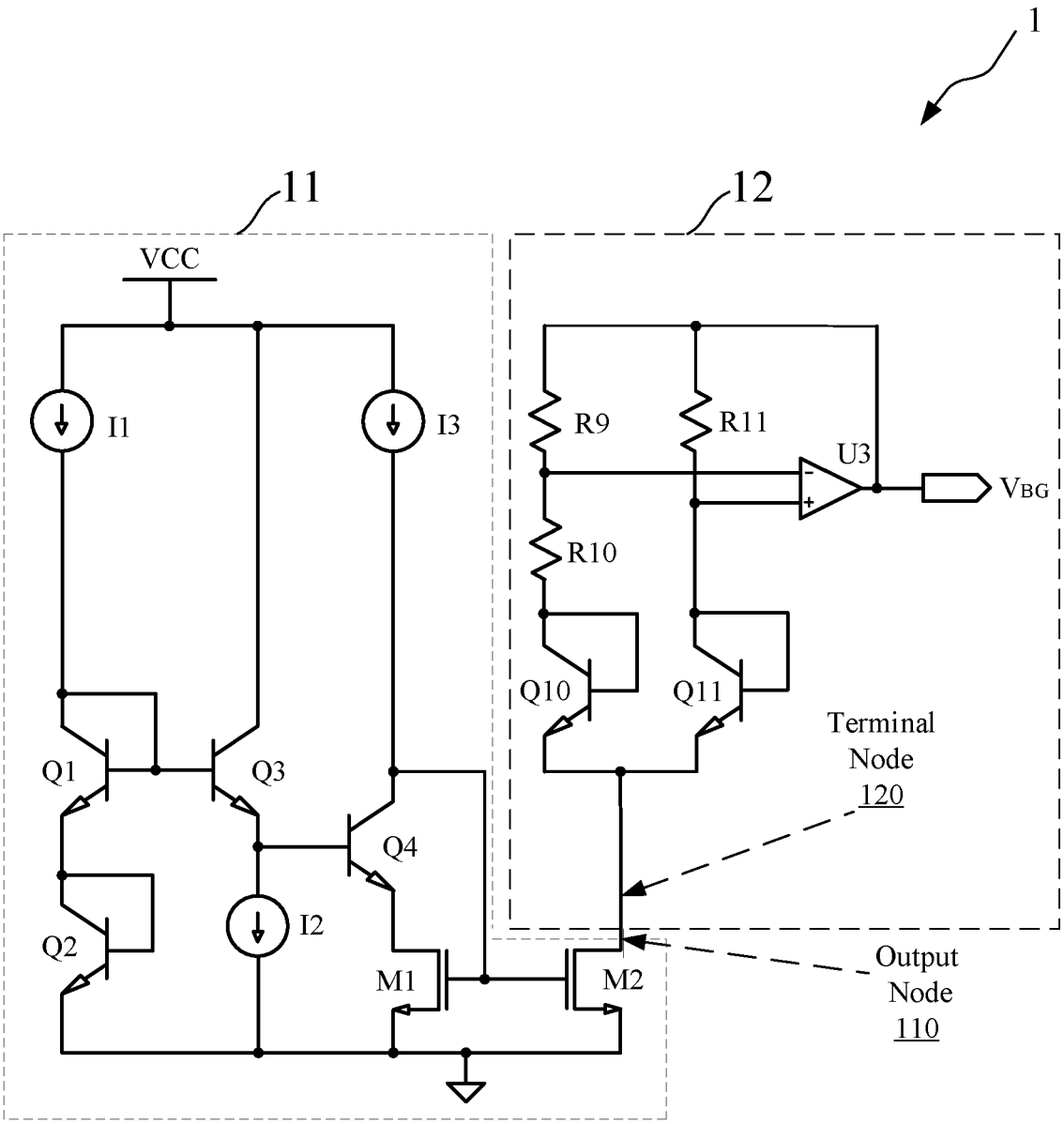
FIG. 5 is schematic diagram showing a third structure of the bandgap reference circuit according to the present disclosure.

FIG. 5 shows a third bandgap reference circuit that can be used in an integrated circuit and/or electronic device, in accordance with at least some embodiments of the present disclosure. In FIG. 5, a bandgap reference circuit 1 may include, among other components and modules not shown, a compensation module 11 and a basic reference module 12. The basic reference module 12 may generate a basic reference voltage which contains a first order TC component and high order nonlinear TC component. The compensation module 11 may generate a compensation voltage to correct the high order nonlinear curvature in the basic reference voltage. The compensation module 11 may include one or more current sources being PTAT, one or more current sources with TC of zero, and one or more transistors.

As shown in FIG. 5, the compensation module 11 may be similar to the compensation module 11 of FIG. 1. The drain of the second NMOS transistor M2 is labelled as the output node 110. The basic reference module 12 of FIG. 5 is different from the basic reference module 12 of FIG. 1 or that of FIG. 4. Specifically, the basic reference module 12 includes the ninth resistor R9, the tenth resistor R10, the eleventh resistor R11, the tenth NPN transistor Q10, the eleventh NPN transistor Q11, and the third amplifier U3.

In some embodiments, the first terminal of the ninth resistor R9 is connected to the output of the third amplifier U3, and the second terminal of the ninth resistor R9 is connected to the first terminal of the tenth resistor R10. The second terminal of the tenth resistor R10 is connected to the collector of the tenth NPN transistor Q10. The base of the tenth NPN transistor Q10 is connected to its collector, and its emitter is labelled as 'terminal node 110 of the basic reference module 12.

The first terminal of the eleventh resistor R11 is connected to the output of the third amplifier U3, and the second terminal of the eleventh resistor R11 is connected to the collector of the eleventh NPN transistor Q11. The eleventh resistor R11 and the ninth resistor R9 are of the same resistance value. The base of the eleventh NPN transistor Q11 is connected to its collector, and its emitter is connected to the terminal node 120 of the basic reference module 12. The ratio between emitter area of the tenth NPN transistor Q10 and that of the eleventh NPN transistor Q11 is $n_3$:1. The specific value of $n_3$ can be set as required.

The inverting input of the third amplifier U3 is connected to the second terminal of the ninth resistor R9, the non-inverting input of the third amplifier U3 is connected to the collector of the eleventh NPN transistor Q11, and the output of the third amplifier U3 provides the reference voltage $V_{BGC}$. In some embodiments, the terminal node 120 of the basic reference module 12 is connected to the output node 110 of the compensation module 11.

Based on the basic reference module 12 shown in FIG. 5, it can be shown that:

$$V_{BGC} = V_{BE11} + \frac{R_{11}}{R_{10}} \cdot \frac{kT}{q} \cdot \ln(n_3) + 2 \cdot \frac{kT}{q} \cdot \frac{\ln(n_3)}{R_{10}} \cdot r_{ds2}, \tag{15}$$

where $V_{BE11}$ is the base-emitter voltage of the eleventh NPN transistor Q11, $R_{10}$ is the resistance value of the tenth resistor R10, $R_{11}$ is the resistance value of the eleventh resistor R11, $n_3$ is the ratio between the emitter area of the tenth NPN transistor Q10 and that of the eleventh NPN transistor Q11.

Therefore, combining equations (4), (8)~(10), and equation (15), we find the composite reference voltage $V_{BGC}$ satisfies the following relationship:

$$V_{BGC} = V_{G0} - [V_{G0} - V_{BE0}]\frac{T}{T_0} - \frac{kT}{q}(\eta - \theta)\ln\left(\frac{T}{T_0}\right) + \frac{R_{11}}{R_{10}} \cdot \frac{kT}{q} \cdot \ln(n_3) + 2 \cdot \frac{kT}{q} \cdot \frac{\ln(n_3)}{R_{10}} \cdot \frac{k}{q \cdot a_2 \cdot m_1} \cdot \ln\left(\frac{a_1^2 \cdot T}{a_2 \cdot I_{const1}}\right) \tag{16}$$

By setting appropriate $$\frac{R_{11}}{R_{10}},$$

$I_{const1}$, $a_1$, $a_2$ and $m_1$, the first-order linear component T in the second term and the third term can be cancelled by that in the fourth term and fifth term, and the high-order nonlinear component T ln(T) in the third term can be cancelled by that in the fifth term, thereby resulting in a composite reference voltage with improved temperature stability.

In other words, when its terminal node is grounded, the basic reference module 12 may generate a basic reference voltage that contains a first linear TC term and a first nonlinear TC term. The compensation module 11 may generate a compensation voltage which contains a second linear TC term and a second nonlinear TC term. When the terminal node 120 of basic reference module 12 is connected to the output node 110 of the compensation module 11, the compensation voltage is in series with the basic reference voltage. In this case, the bandgap reference circuit may compensate the first linear TC term with the second linear TC term, and compensate the first nonlinear TC term with the second nonlinear TC term. For example, the first linear TC term may be positive, and the second linear TC term may be negative, and these two linear TC terms may cancel out each other when combined. The first nonlinear TC term and the second nonlinear TC term may be likewise combined to cancel each other. The resulting composite reference voltage, which appears at the output of the bandgap reference circuit, may become temperature independent.

Embodiment 4

Figure 6:
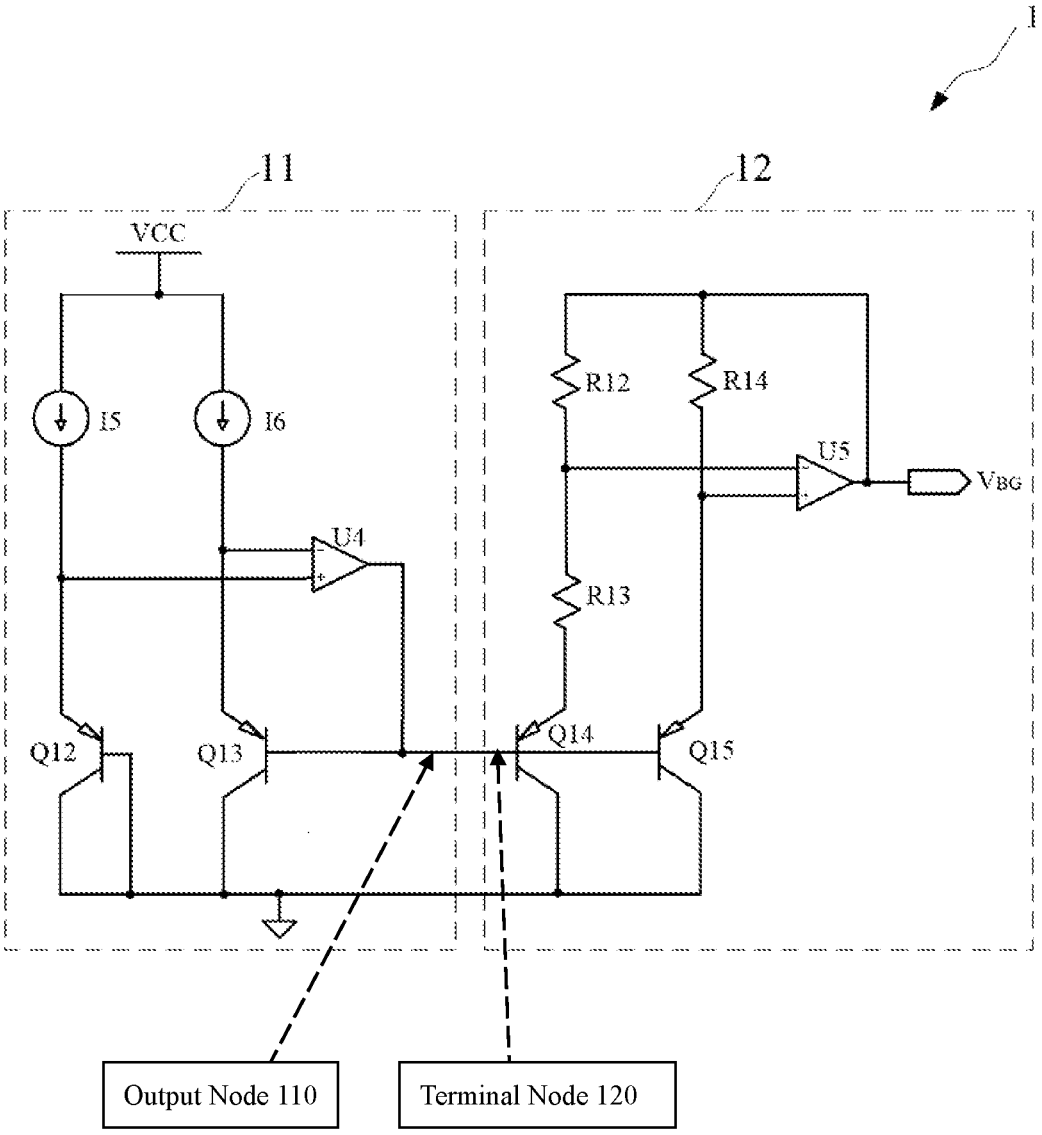
FIG. 6 is a schematic diagram showing a fourth structure of the bandgap reference circuit according to the present disclosure.

FIG. 6 shows a fourth bandgap reference circuit that can be used in an integrated circuit and/or electronic device, in accordance with at least some embodiments of the present disclosure. In FIG. 6, a bandgap reference circuit 1 may include, among other components and modules not shown, a compensation module 11 and a basic reference module 12. The basic reference module 12 may generate a basic reference voltage which contains a first order TC component and high order nonlinear TC component. The compensation module 11 may generate a compensation voltage to correct the high order nonlinear curvature in the basic reference voltage. The compensation module 11 may include one or more current sources being proportional to absolute temperature, one or more current sources with a temperature coefficient of zero, and one or more transistors.

In FIG. 6, the compensation module 11 includes the fifth current source IS, the sixth current source 16, the first PNP transistor Q12, the second PNP transistor Q13, the fourth amplifier U4. The anode of the fifth current source 15 is connected to the power supply VCC, and the cathode of the fifth current source 15 is connected to the emitter of the first PNP transistor Q12. The fifth current source 15 is proportional to absolute temperature (PTAT). In this embodiment, the current flowing through the fifth current source 15 is set to be $a_3$*T. The base and the collector of the first PNP transistor Q12 are grounded.

In some embodiments, the anode of the sixth current source 16 is connected to the power supply VCC, and the cathode of the sixth current source 16 is connected to the emitter of the second PNP transistor Q13. The current flowing through the sixth current source 16 is of fixed value. In this embodiment, the current flowing through the sixth current source 16 is set to be $I_{const2}$, independent of temperature. The collector of the second PNP transistor Q13 is grounded. The ratio between the emitter area of the first PNP transistor Q12 and that of the second PNP transistor Q13 is 1:$m_2$. The specific value of $m_2$ can be set as required.

The inverting input of the fourth amplifier U4 is connected to the emitter of the second PNP transistor Q13, the non-inverting input of the fourth amplifier U4 is connected to the emitter of the first PNP transistor Q12, and the output of the fourth amplifier U4 is connected to the base of the second PNP transistor Q13, which is the output node 110 of the compensation module 11.

In some embodiments, the basic reference module 12 includes the twelfth resistor R12, the thirteenth resistor R13, the fourteenth resistor R14, the third PNP transistor Q14, the fourth PNP transistor Q15, and the fifth amplifier U5. The first terminal of the twelfth resistor R12 is connected to the output of the fifth amplifier U5, and the second terminal of the twelfth resistor R12 is connected to the first terminal of the thirteenth resistor R13. The second terminal of the thirteenth resistor R13 is connected to the emitter of the third PNP transistor Q14. The base of the third PNP transistor Q14 is connected to the output of the compensation module 11, and its collector is grounded.

In some embodiments, the first terminal of the fourteenth resistor R14 is connected to the output of the fifth amplifier U5, and the second terminal of the fourteenth resistor R14 is connected to the emitter of the fourth PNP transistor Q15. The fourteenth resistor R14 and the twelfth resistor R12 are of the same resistance value. The base of the fourth PNP transistor Q15 is connected to the output of the compensation module 11, and the collector of the fourth PNP transistor Q15 is grounded. The ratio between the emitter area of the third PNP transistor Q14 and that of the fourth PNP transistor Q15 is $n_4$:1. The specific value of $n_4$ can be set as required.

The inverting input of the fifth amplifier U5 is connected to the second terminal of the twelfth resistor R12 the non-inverting input of the fifth amplifier U5 is connected to the emitter of the fourth PNP transistor Q15, and the output of the fifth amplifier U5 provides the reference voltage $V_{BG}$. Further, the base of the third PNP transistor Q14 and the base of the fourth PNP transistor Q15 are connected, labelled as the terminal node 120 of the basic reference module 12.

Since the collector of these PNP transistors is p-substrate in some processes, this embodiment modifies the curvature compensation scheme and biases the bases of the third PNP transistor Q14 and the fourth PNP transistor Q15 accordingly.

In the compensation module 11 of FIG. 6, it can be shown that:

$$V_B = \frac{kT}{q} \cdot \ln\left(\frac{a_3 \cdot T \cdot m_2}{I_{const2}}\right), \tag{17}$$

where $V_B$ is the base voltage of the second PNP transistor Q13, ignoring the difference in θ between the first PNP transistor Q12 and the second PNP transistor Q13. Following the basic reference module 12, it can be shown that:

$$V_{BG} = V_{BE15} + \frac{R_{14}}{R_{13}} \cdot \frac{kT}{q} \cdot \ln(n_4) + \frac{kT}{q} \cdot \ln\left(\frac{a_3 \cdot T \cdot m_2}{I_{const2}}\right), \tag{18}$$

where $V_{BE15}$ is the base-emitter voltage of the fourth PNP transistor Q15, $R_{13}$ is the resistance value of the thirteenth resistor R13, $R_{14}$ is the resistance value of the fourteenth resistor R14, $n_4$ is the ratio between the emitter area of the third PNP transistor Q14 and that of the fourth PNP transistor Q15. Therefore, combining equations (4), (17)-(18), we find the composite reference voltage $V_{BG}$ satisfies the following relationship:

$$V_{BGC} = V_{G0} - [V_{G0} - V_{BE0}]\frac{T}{T_0} - \frac{kT}{q}(\eta - \theta)\ln\left(\frac{T}{T_0}\right) + \frac{R_{14}}{R_{13}} \cdot \frac{kT}{q} \cdot \ln(n_4) + \frac{kT}{q}\left(\frac{a_3 \cdot T \cdot m_2}{I_{const2}}\right) \tag{19}$$

By setting appropriate $$\frac{R_{14}}{R_{13}},$$

$I_{const2}$, $a_3$ and $m_2$, the first-order component T in the second term and the third term can be cancelled by that in the fourth term and the fifth term, and the high-order non-linear component T ln(T) in the third term can be cancelled by that the fifth term, resulting in a composite reference voltage with improved temperature stability.

The bandgap reference circuit of the present disclosure greatly improves the stability of the reference voltage over temperature by compensating for the high-order non-linear component T ln(T). Embodiments 1 to 4 are just exemplary implementations of the present disclosure. Any circuit structure that can compensate the temperature curvature of the reference voltage are included in the present disclosure, and are not described in detail here.

In other words, when its terminal node 120 is grounded, the basic reference module 12 may generate a reference voltage that contains a first linear TC term and a first nonlinear TC term. The compensation module 11 may generate a compensation voltage which contains a second linear TC term and a second nonlinear TC term. When the terminal node 120 of the basic reference module 12 is connected to the output node 110 of the compensation module 11, the compensation voltage is in series with the basic reference voltage. In this case, the bandgap reference circuit may compensate the first linear TC term with the second linear TC term, and compensate the first nonlinear TC term with the second nonlinear TC term. For example, the first linear TC term may be positive, and the second linear TC term may be negative, and these two linear TC terms may cancel each other out when combined. The first nonlinear TC term and the second nonlinear TC term may be likewise combined to cancel each other. The resulting composite reference voltage, which appears at the output of the bandgap reference circuit, may become temperature independent.

In some embodiments, the above bandgap reference circuits may be implemented in an electronic device or an integrated circuit. Specifically, the reference voltage outputted by the bandgap reference circuit may supply to other circuits in the electronic device or the integrated circuit.

The above-mentioned embodiments are just used for exemplarily describing the principle and effects of the present disclosure instead of limiting the present disclosure. Those skilled in the art can make modifications or changes to the above-mentioned embodiments without going against the spirit and the range of the present disclosure. Therefore, all equivalent modifications or changes made by those who have common knowledge in the art without departing from the spirit and technical concept disclosed by the present disclosure shall be still covered by the claims of the present disclosure.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In some embodiments, several portions of the subject matter described herein may be implemented via Application Specific Integrated Circuits (ASICs), System on Chip (SOC), sensors, analog front end (AFE), Field Programmable Gate Arrays (FPGAs), digital signal processors (DSPs), or other integrated formats.

The herein described subject matter sometimes illustrates different components contained within, or coupled with, different other components. It is to be understood that such depicted architectures are merely examples and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to"). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

The invention claimed is:

1. A bandgap reference circuit, comprising:

a basic reference module to generate a basic reference voltage containing a first linear temperature-coefficient (TC) term and a first nonlinear TC term when a terminal node in the basic reference module is grounded; and a compensation module having an output node coupled to the terminal node of the basic reference module, wherein the compensation module generates a compensation voltage, containing a second linear TC term and a second nonlinear TC term by using a first set of current sources proportional to absolute temperate (PTAT) and a second set of current sources with temperature coefficient (TC) of zero, and the compensation voltage is in series with the basic reference voltage to compensate the first linear TC term in the basic reference voltage with the second linear TC term in the compensation voltage, and compensate the first nonlinear TC term in the basic reference voltage with the second nonlinear TC term in the compensation voltage.

2. The bandgap reference circuit according to claim 1, wherein the bandgap reference circuit generates a composite reference voltage as a sum of the basic reference voltage and the compensation voltage with temperature stability.

3. The bandgap reference circuit according to claim 1, wherein the basic reference module comprises a terminal resistor connected to the terminal node in the reference-voltage module; and the compensation module comprises a first current source, a second current source, a third current source, a first NPN transistor, a second NPN transistor, a third NPN transistor, a fourth NPN transistor, a first NMOS transistor, and a second NMOS transistor, wherein an anode of the first current source is coupled to a power supply, and a cathode of the first current source is coupled to a collector of the first NPN transistor, a base of the first NPN transistor is coupled to the collector of the first NPN transistor, and an emitter of the first NPN transistor is coupled to a collector of the second NPN transistor, a base of the second NPN transistor is coupled to the collector of the second NPN transistor, and the emitter of the second NPN transistor is grounded, a collector of the third NPN transistor is coupled to the power supply, a base of the third NPN transistor is coupled to the base of the first NPN transistor, an emitter of the third NPN transistor is coupled to an anode of the second current source, and the cathode of the second source is grounded, an anode of the third current source is coupled to the power supply, and a cathode of the third current source is coupled to a collector of the fourth NPN transistor, a base of the fourth NPN transistor is coupled to the emitter of the third NPN transistor, an emitter of the four NPN transistor is coupled to a drain of the first NMOS transistor, a gate of the first NMOS transistor is coupled to a collector of the fourth NPN transistor, and the source of the first NMOS transistor is grounded, a source of the second NMOS transistor is grounded, a gate of the second NMOS transistor is coupled to the gate of the first NMOS transistor, and a drain of the second NMOS transistor is connected to the output node of the compensation module, the output node provides the compensation voltage.

4. The bandgap reference circuit according to claim 3, wherein the first current source and the third current source are selected from the first set of current sources with currents that are proportional to absolute temperature, and the second current source is selected from the second set of current sources with currents that is constant over temperature.

5. The bandgap reference circuit according to claim 3, wherein the first NMOS transistor and the second NMOS transistor operate in triode.

6. The bandgap reference circuit according to claim 3, wherein the basic reference module comprises a first resistor, a second resistor, a third resistor being the terminal resistor, a fourth resistor, a fifth NPN transistor, a sixth NPN transistor, and a first amplifier, a first terminal of the first resistor is coupled to the power supply, and a second terminal of the first resistor is coupled to a collector of the fifth NPN transistor, an emitter of the fifth NPN transistor is coupled to a first terminal of the second resistor while a second terminal of the second resistor is coupled to a first terminal of the third resistor, a first terminal of the fourth resistor is coupled to the power supply, and a second terminal of the fourth resistor is coupled to a collector of the sixth NPN transistor, an emitter of the sixth NPN transistor is coupled to the first terminal of the third resistor, a second terminal of the third resistor is connected to the terminal node of the basic reference module, and an inverting input of the first amplifier is coupled to a collector of the fifth NPN transistor, a non-inverting input of the first amplifier is coupled to the collector of the sixth NPN transistor, and an output of the first amplifier for providing the reference voltage is coupled to a base of the fifth NPN transistor and to a base of the sixth NPN transistor.

7. The bandgap reference circuit according to claim 1, wherein the basic reference module comprises a first current source, a first resistor, a second resistor, a third resistor, a fourth resistor, a first NPN transistor, a second NPN transistor, a third NPN transistor, and a first amplifier, a first terminal of the first resistor is coupled to a power supply, and a second terminal of the first resistor is coupled to a collector of the first NPN transistor, an emitter of the first NPN transistor is coupled to an anode of the first current source, and a cathode of the first current source is grounded, a first terminal of the second resistor is coupled to the power supply, and a second terminal of the second resistor is coupled to a collector of the second NPN transistor, an emitter of the second NPN transistor is coupled to the anode of the first current source, an inverting input of the first amplifier is coupled to the collector of the first NPN transistor, a non-inverting input of the first amplifier is coupled to the collector of the second NPN transistor, and an output of the first amplifier providing the reference voltage is coupled to a base of the second NPN transistor, a first terminal of the third resistor is coupled to the output of the first amplifier, and a second terminal of the third resistor is coupled to a base of the first NPN transistor, a first terminal of the fourth resistor is coupled to the base of the first NPN transistor, and a second terminal of the fourth resistor is coupled to a collector of the third NPN transistor, and a base of the third NPN transistor is coupled to the collector of the third NPN transistor, an emitter of the third NPN transistor is coupled to the terminal node of the basic reference module.

8. The bandgap reference circuit according to claim 1, wherein the basic reference module comprises a first resistor, a second resistor, a third resistor, a first NPN transistor, a second NPN transistor, and a first amplifier, a first terminal of the first resistor is coupled to an output of the first amplifier, a second terminal of the first resistor is coupled to a first terminal of the second resistor, and a second terminal of the second resistor is coupled to a collector of the first NPN transistor, a first terminal of the third resistor is coupled to the output of the first amplifier, and a second terminal of the third resistor is coupled to a collector of the second NPN transistor, a base of the first NPN transistor is coupled to the collector of the first NPN transistor, an emitter of the first NPN transistor is coupled to the terminal node of the basic reference module, a base of the second NPN transistor is coupled to the collector of the second NPN transistor, and an emitter of the second NPN transistor is coupled to the first NPN emitter, and an inverting input of the first amplifier is coupled to a second terminal of the first resistor, a non-inverting input of the first amplifier is coupled to the collector of the second NPN transistor, and the output of the first amplifier provides the reference voltage.

9. The bandgap reference circuit according to claim 1, wherein the compensation module comprises a first current source, a second current source, a first PNP transistor, a second PNP transistor, a first amplifier, an anode of the first current source is coupled to a power supply, and a cathode of the first current source is coupled to an emitter of the first PNP transistor, a base and a collector of the first PNP transistor are grounded, an anode of the second current source is coupled to the power supply, and a cathode of the second current source is coupled to an emitter of the second PNP transistor, a collector of the second PNP transistor is grounded, an inverting input of the first amplifier is coupled to the emitter of the first PNP transistor, a non-inverting input of the first amplifier is coupled to the emitter of the second PNP transistor, an output of the first amplifier is coupled to the base of the first PNP transistor and the base of the second PNP transistor, the output of the first amplifier is coupled to the output node of the compensation module.

10. The bandgap reference circuit according to claim 9, wherein the first current source is selected from the first set of current sources that are proportional to absolute temperature, and the second current source is selected from the second set of current sources with TC of zero.

11. The bandgap reference circuit according to claim 9, wherein the basic reference module comprises a first resistor, a second resistor, a third resistor, a third PNP transistor, a fourth PNP transistor, and a second amplifier, a first terminal of the first resistor is coupled to an output of the second amplifier, a second terminal of the first resistor is coupled to a first terminal of the second resistor, and a second terminal of the second resistor is coupled to an emitter of the third PNP transistor, a base of the third PNP transistor is coupled to the terminal node of the basic reference module, and a collector of the third PNP transistor is grounded, a first terminal of the third resistor is coupled to the output of the second amplifier, and a second terminal of the third resistor is coupled to an emitter of the fourth PNP transistor, a base of the fourth PNP transistor is coupled to the base of the third PNP transistor, and a collector of the fourth PNP transistor is grounded, and an inverting input of the second amplifier is coupled to a second terminal of the first resistor, a non-inverting input of the second amplifier is coupled to the emitter of the fourth PNP transistor, and an output of the second amplifier provides the reference voltage.

12. An electronic device including a bandgap reference circuit, wherein the bandgap reference circuit comprises:

a basic reference module to generate a basic reference voltage, wherein the basic reference voltage contains a first linear temperature-coefficient (TC) term and a first nonlinear TC term when a terminal node in the basic reference module is grounded; and a compensation module having an output node coupled to the terminal node of the basic reference module, wherein the compensation module generates a compensation voltage with a second linear TC term and a second nonlinear TC term by using a first set of current sources proportional to absolute temperate (PTAT) and a second set of current sources with temperature coefficient (TC) of zero, and the bandgap reference circuit generates a temperature independent composite reference voltage by combining the basic reference voltage and the compensation voltage, thereby cancelling the first linear TC term with the second linear TC term and cancelling the first nonlinear TC term with the second nonlinear TC term.

13. The electronic device according to claim 12, wherein the basic reference module comprises a resistor connected to the terminal node of the basic reference-module, and the compensation module comprises a NMOS transistor with a drain connected to the output node of the compensation module, the output node is coupled to the terminal node of the basic reference module, and the compensation module creates the compensation voltage.

14. The electronic device according to claim 12, wherein the basic reference module comprises a NPN transistor with an emitter coupled to the terminal node of the basic reference module, and the compensation module comprises a NMOS transistor with a drain coupled to the output node of the compensation module, the output node is coupled to the terminal node of the basic reference module, and the compensation module creates the compensation voltage.

15. The electronic device according to claim 12, wherein the basic reference module comprises a first NPN transistor with its emitter connected coupled to terminal node of the basic reference module and a second NPN transistor with its emitter coupled to the terminal node, and the compensation module comprises a NMOS transistor with a drain coupled to the output node of the compensation module, the output node is coupled to the terminal node of the basic reference module, and the compensation module creates the compensation voltage.

16. The electronic device according to claim 12, wherein the basic reference module comprises a first PNP transistor with its base coupled to the terminal node of the basic reference module and a second PNP transistor with its base coupled to the terminal node, and the compensation module comprises a first PNP and second PNP with their bases coupled to an output of amplifier, the output of amplifier is coupled to the output node of the compensation module, the output node is coupled to the terminal node of the basic reference module and the compensation module creates the compensation voltage.

17. An integrated circuit including a bandgap reference circuit, the bandgap reference circuit comprising a basic reference module and a compensation module having an output node coupled to a terminal node of the basic reference module, wherein the basic reference module generates a basic reference voltage, the basic reference voltage containing a first linear temperature coefficient (TC) term and a first nonlinear TC term when the terminal node is grounded, the compensation module generates a compensation voltage at the output node with a second linear TC term and a second nonlinear TC term by using a first set of current sources proportional to absolute temperate (PTAT) and a second set of current sources with TC of zero, and the bandgap reference circuit generates a temperature independent composite reference voltage by connecting the terminal node of the basic reference module and the output node of the compensation module, cancelling the first linear TC term with the second linear TC term, and cancelling the first nonlinear TC term with the second nonlinear TC term.

18. The integrated circuit according to claim 17, wherein the basic reference module comprises a terminal resistor connected to the terminal node in the reference-voltage module, and the compensation module comprises a NMOS transistor, a drain of the NMOS transistor is connected to the output node of the compensation module, and the output node provides the compensation voltage.

19. The integrated circuit according to claim 17, wherein the basic reference module comprises a NPN transistor, and an emitter of the NPN transistor is coupled to the terminal node of the basic reference module, and the compensation module comprises a NMOS transistor, a drain of the NMOS transistor is connected to the output node of the compensation module, and the output node provides the compensation voltage.

20. The integrated circuit according to claim 17, wherein the basic reference module comprises a first NPN transistor and a second NPN transistor, an emitter of the first NPN transistor is coupled to the terminal node of the basic reference module, and an emitter of the second NPN transistor is coupled to the terminal node of the basic reference module, and the compensation module comprises a NMOS transistor, a drain of the NMOS transistor is connected to the output node of the compensation module, and the output node provides the compensation voltage.

* * * * *